US011186944B1

(12) United States Patent
Salem

(10) Patent No.: US 11,186,944 B1
(45) Date of Patent: Nov. 30, 2021

(54) METHOD OF MAKING POLYESTER FABRIC TREATED WITH A CBD POWDER

(71) Applicant: Jesse Salem, New York, NY (US)

(72) Inventor: Jesse Salem, New York, NY (US)

(73) Assignee: Sam Salem and Son, LLC, New York, NY (US)

( * ) Notice: Subject to any disclaimer, the term of this patent is extended or adjusted under 35 U.S.C. 154(b) by 0 days.

(21) Appl. No.: 16/660,911

(22) Filed: Oct. 23, 2019

(51) Int. Cl.
*D06M 13/152* (2006.01)
*D06B 3/10* (2006.01)
*D06M 101/32* (2006.01)

(52) U.S. Cl.
CPC ..... *D06M 13/152* (2013.01); *D06B 3/10* (2013.01); *D06M 2101/32* (2013.01); *D10B 2331/04* (2013.01)

(58) Field of Classification Search
None
See application file for complete search history.

(56) References Cited

U.S. PATENT DOCUMENTS 10,568,865 B2 * 2/2020 Levy ..... A61K 36/185

FOREIGN PATENT DOCUMENTS

CN 101502343 A * 8/2009 ..... A61K 47/50
CN 104746171 A * 7/2015
CN 106436324 A * 2/2017

OTHER PUBLICATIONS

CBD-Infused Pillowcases. http://www.cbdsleepstore.com/ (accessed Sep. 11, 2020). (Year: 2019).*
Royal Heritage Home mellows out with new CBD collection. http://www.hometextilestoday.com/manufacturers/royal-heritage-home-mellows-out-with-new-cbd-collection (accessed Sep. 11, 2020). (Year: 2020).*

* cited by examiner

*Primary Examiner* — William P Fletcher, III
(74) *Attorney, Agent, or Firm* — Ezra Sutton

(57) ABSTRACT

This invention relates to a method for making polyester fabric treated with a CBD powder to provide a novel CBD finish on the polyester fabric. The polyester fabric is treated with a CBD powder to provide a novel finish. The treatment process includes a washing step, wherein the treating CBD water is added to a water channel before the finishing step. Then, the polyester fabric is passed through the water channel having the treating CBD water in the ratio of 1:1000, which is one gram of CBD powder to each 1000 grams of water. The flow rate of the treating CBD water has a ratio of 5:1000, which adds 5 grams of CBD powder to each 1000 grams of water in order to apply the correct treatment of CBD water. In addition, the polyester fabric moves at a speed of approximately 20 meters per minute through the water channel, and the bathing treatment has a normal temperature of 30-35° C. The maximum temperature of the drying machine is 220° C., but has a preferred range of 170-220° C. In addition, the polyester fabric passes through the drying machine at a speed of 20 meters per minute.

2 Claims, No Drawings

METHOD OF MAKING POLYESTER FABRIC TREATED WITH A CBD POWDER

FIELD OF THE INVENTION

This invention relates to a method for making polyester fabric treated with a CBD powder.

BACKGROUND OF THE INVENTION

This invention relates to a method for making polyester fabric treated with a CBD powder. Polyester fabric is a commonly used fabric. However, in the present invention, a novel treatment method is used to treat the polyester fabric with CBD powder.

DESCRIPTION OF THE PRIOR ART

Japanese Pat. No. JPH02289136 (A) to Ueno Kenichi entitled "Cotton-Bast Fiber Blended Yarn and Production Thereof" issued on Nov. 29, 1990. The '136 Japanese patent, discloses a blended yarn suitable as a raw material for clothing such as shirts by passing each specified fineness of hemp fiber and cotton fiber from a raw state through a mixing and blowing, a card and a comber to remove a specified amount of short fiber followed by passing through a roving frame and a fine spinning frame into yarn. Preferably the hemp fiber is 3.0-7.0 denier in fineness and the cotton fiber is <=1.8 denier in fineness are passed from their raw state through a mixing and blowing, a card, and a comber to remove 10-20 wt. % of short fiber followed by passing through a roving frame and a fine spinning frame into yarn, thus obtaining the objective blended yarn comprising (A) hemp fiber 28-42 mm in average fiber length and 3.0-7.0 denier in fineness and (B) cotton fiber 28-42 mm in average fiber length and <=1.8 denier in fineness, with the hemp fiber accounting 10-60 wt. % of the entire yarn.

Abandoned U.S. Patent App. Pub. No. 2009/0173054 to Scott H. Silver entitled "Composite Cotton and Hemp Yarn and Method for Making the Same" was published on Jul. 9, 2009 and is now abandoned. The '054 patent application discloses a composite hemp and cotton yarn formed by blending hemp fibers with cotton fibers which have been regenerated from waste cotton material such as trimmings and cuttings from the apparel manufacturing industry. The fibers are cleaned and blended, then carded to align the fibers into strands. Depending on the size and texture of the desired yarn, the fibers are stretched and drawn into slivers prior to spinning to join the fibers together. The hemp fibers are up to three time longer than the regenerated cotton fibers, so that the hemp fibers overlap and braid onto the regenerated cotton fibers during spinning. The resultant yarn is stronger and more absorbent than yarns made solely out of regenerated cotton fibers or a blend of cotton and acrylic or cotton and polyester fibers. The finished yarn is between 30 and 45% recycled and regenerated cotton fibers which are generally shorter than the natural hemp fibers.

OBJECTS OF THE INVENTION

It is an object of the present invention to provide a novel method of treating polyester fabric with a CBD powder.

It is another object of the present invention to potentially provide a better rest.

It is another object of the present invention to potentially relieve anxiety.

SUMMARY OF THE INVENTION

This invention relates to a method for making polyester fabric treated with a CBD powder to provide a novel CBD finish on the polyester fabric. The polyester fabric is treated with a CBD powder to provide a novel finish. The treatment process includes a washing step, wherein the treating CBD water is added to a water channel before the finishing step. Then, the polyester fabric is passed through the water channel having the treating CBD water in the ratio of 1:1000, which is one gram of CBD powder to each 1000 grains of water. The flow rate of the treating CBD water has a ratio of 5:1000, which adds 5 grains of CBD powder to each 1000 grams of water in order to apply the correct treatment of CBD water. In addition, the polyester fabric moves at a speed of approximately 20 meters per minute through the water channel, and the bathing treatment has a normal temperature of 30-35° C. The maximum temperature of the drying machine is 220° C., but has a preferred range of 170-220° C. In addition, the polyester fabric passes through the drying machine at a speed of 20 meters per minute.

DETAILED DESCRIPTION OF THE EMBODIMENTS

This invention relates to a method for making polyester fabric treated with a CBD powder. The present invention relates to making and treating a polyester fabric treated with a CBD powder to obtain a CBD finish on the polyester fabric using a novel CBD treatment process.

The treatment process includes the following steps for treating the polyester fabric. The first step includes singeing the fabric, desizing it, washing it, and bleaching it. Then the polyester fabric may have a white finish, or it is mercerized and then color dyed.

After that, the polyester fabric is then finished with CBD powder at 160° C. Then, the CBD treated polyester fabric is sanforized.

The CBD treatment process of the present invention is further described in the 3 embodiments set forth below.

First Embodiment

In this first embodiment, during the washing step, the treating CBD water is added to the water channel before the finishing step. The polyester fabric is passed through the water channel having the treating CBD water in the ratio of 1:1000, which is 1 gram of CBD powder to each 1000 grams of water. Also, the flow rate of the treating CBD water has a ratio of 5:1000, which adds 5 grams of CBD powder to each 1000 grams of water in order to apply the correct treatment of CBD water.

In addition, the polyester fabric moves at a speed of approximately 20 meters per minute through the water channel, and the bathing treatment has a normal temperature of 30-35° C.

Second Embodiment

When the polyester fabric passes through the roller, the temperature setting is 30-35° C.

Third Embodiment

The process starts with the machine temperature having a setting of 140° C. Also, the maximum temperature of the drying machine is 220° C., and has a preferred range of 170-220° C. The polyester fabric passes through the drying machine in approximately 2 minutes and the drying machine is running at a speed of 20 meters per minute.

In this manner, the CBD powder is added to the polyester fabric in the most efficient manner.

For all of the embodiments, it is noted that even though the CBD powder dissolves in the water, the treated polyester fabric can be washed only 10 times. After that, the CBD powder does not stay in the fabric.

OPERATION OF THE INVENTION

This invention relates to a polyester fabric having treated with CBD powder, and a method for making same. The invention includes treating a polyester fabric with a CBD powder to provide a CBD finish using a CBD treatment process. The polyester fabric is treated with a CBD powder at 160° C. The treatment process includes a washing step, wherein the treating CBD water is added to a water channel before the finishing step. Then, the polyester fabric is passed through the water channel having the treating CBD water in the ratio of 1:1000, which is one gram of CBD powder to each 1000 grams of water. The flow rate of the treating CBD water has a ratio of 5:1000, which adds 5 grams of CBD powder to each 1000 grams of water in order to apply the correct treatment of CBD water. In addition, the polyester fabric moves at a speed of approximately 20 meters per minute through the water channel, and the bathing treatment has a normal temperature of 30-35° C. The maximum temperature of the drying machine is 220° C., but has a preferred range of 170-220° C. In addition, the polyester fabric passes through the drying machine at a speed of 20 meters per minute.

ADVANTAGES OF THE PRESENT INVENTION

It is an advantage of the present invention to provide a novel method of treating polyester fabric with a CBD powder.

Another advantage of the present invention is to potentially provide a better rest.

Another advantage of the present invention is to potentially relieve anxiety.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A method for making a CBD-treated polyester fabric comprising:

a) providing a polyester fabric;

b) adding CBD water to a water channel, said CBD water containing 1 g of CBD powder per 1000 g of water;

c) washing said polyester fabric by passing said polyester fabric through said CBD water in said water channel at a speed of 20 m/min and a temperature of 30-35° C., while increasing the concentration of said CBD powder in said CBD water to 5 g of CBD powder per 1000 g of water, to provide the polyester fabric with a CBD finish thereon; and d) drying said polyester fabric having a CBD finish thereon at a speed of 20 m/min and a temperature of 140-220° C.

2. The method of claim 1, wherein the polyester fabric having a CBD finish thereon is dried at a temperature of 170-220° C.

* * * * *